US011152148B2

(12) United States Patent
Takeda et al.

(10) Patent No.: US 11,152,148 B2
(45) Date of Patent: Oct. 19, 2021

(54) COIL COMPONENT

(71) Applicant: Murata Manufacturing Co., Ltd., Kyoto-fu (JP)

(72) Inventors: Yasushi Takeda, Nagaokakyo (JP); Mitsuhiro Sato, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 328 days.

(21) Appl. No.: 16/112,268

(22) Filed: Aug. 24, 2018

(65) Prior Publication Data

US 2019/0066912 A1 Feb. 28, 2019

(30) Foreign Application Priority Data

Aug. 31, 2017 (JP) ..... JP2017-167632

(51) Int. Cl.
*H01F 27/29* (2006.01)
*H01F 27/28* (2006.01)
(Continued)

(52) U.S. Cl.
CPC ..... *H01F 27/292* (2013.01); *H01F 17/0013* (2013.01); *H01F 27/2804* (2013.01);
(Continued)

(58) Field of Classification Search
CPC .. H01F 27/292; H01F 27/2804; H01F 27/323; H01F 27/29; H01F 2027/2809;
(Continued)

(56) References Cited

U.S. PATENT DOCUMENTS 8,891,225 B2 * 11/2014 Nishisaka ..... H01G 4/30 361/306.1
2010/0219925 A1 * 9/2010 Yamamoto ..... H01F 41/041 336/199
(Continued)

FOREIGN PATENT DOCUMENTS

CN 107887109 A 4/2018
JP 4816971 B2 11/2011
(Continued)

OTHER PUBLICATIONS

An Office Action issued by the State Intellectual Property Office of the People's Republic of China dated Mar. 30, 2020, which corresponds to Chinese Patent Application No. 201810986529.3 and is related to U.S. Appl. No. 16/112,268. with English language translation.
(Continued)

*Primary Examiner* — Mang Tin Bik Lian
(74) *Attorney, Agent, or Firm* — Studebaker & Brackett PC

(57) ABSTRACT

A coil component includes an element body, a coil provided in the element body, and an outer electrode provided in the element body and electrically connected to the coil. The outer electrode is embedded in one surface of the element body such that a protruding portion, which is a portion of the outer electrode, protrudes from the one surface of the element body. Also, a thickness of an embedded portion, which is a portion of the outer electrode and is embedded in the one surface of the element body, is larger than a thickness of the protruding portion of the outer electrode protruding from the one surface of the element body in thickness in a direction perpendicular to the one surface of the element body.

18 Claims, 8 Drawing Sheets

50 : a plated layer

(51) Int. Cl.
*H01F 41/12* (2006.01)
*H01F 27/32* (2006.01)
*H01F 41/04* (2006.01)
*H01F 17/00* (2006.01)

(52) U.S. Cl.
CPC ..... *H01F 27/323* (2013.01); *H01F 41/043* (2013.01); *H01F 41/122* (2013.01); *H01F 2027/2809* (2013.01)

(58) Field of Classification Search
CPC .. H01F 41/043; H01F 41/122; H01F 17/0013; H01F 2017/048; H01F 2017/0073
See application file for complete search history.

(56) References Cited

U.S. PATENT DOCUMENTS

2013/0062994 A1* 3/2013 Ogawa ..... H01G 4/30 310/311
2015/0009003 A1* 1/2015 Ozawa ..... H01F 27/292 336/200
2016/0012961 A1* 1/2016 Suzuki ..... H01F 27/2804 336/192
2016/0099100 A1* 4/2016 Park ..... H01F 17/0013 336/200
2016/0141102 A1* 5/2016 Tseng ..... H01F 27/292 336/192
2017/0278624 A1* 9/2017 Ogino ..... H01F 27/32
2018/0096769 A1* 4/2018 Sekiguchi ..... H01F 27/292

FOREIGN PATENT DOCUMENTS

JP 2012-104745 A 5/2012
JP 2013-235997 A 11/2013

OTHER PUBLICATIONS

An Office Action; "Notification of Reasons for Refusal," Mailed by the Japanese Patent Office dated Sep. 10, 2019, which corresponds to Japanese Patent Application No. 2017-167632 and is related to U.S. Appl. No. 16/112,268; with English language translation.

* cited by examiner

50 : a plated layer

COIL COMPONENT

CROSS-REFERENCE TO RELATED APPLICATION

This application claims benefit of priority to Japanese Patent Application No. 2017-167632, filed Aug. 31, 2017, the entire content of which is incorporated herein by reference.

BACKGROUND

Technical Field

The present disclosure relates to a coil component.

Background Art

A coil component described in, for example, Japanese Patent No. 4816971 has been known. This coil component has an element body, a coil provided in the element body, and an outer electrode provided on the element body and electrically connected to the coil. The outer electrode does not protrude from surfaces of the element body, and is embedded in the element body. A surface of the outer electrode is exposed from the surface of the element body.

When the above-described coil component of the related art is mounted on a mounting substrate, the outer electrode is fixed to the mounting substrate with solder interposed therebetween. At this time, since the solder is in contact only with the surface of the outer electrode, fixing force between the coil component and the mounting substrate may be low.

SUMMARY

Accordingly, the present disclosure provides a coil component capable of suppressing separation of an outer electrode from an element body while improving fixing force between the coil component and a mounting substrate.

A coil component according to preferred embodiments of the present disclosure includes an element body, a coil provided in the element body, and an outer electrode provided on the element body and electrically connected to the coil. The outer electrode is embedded in one surface of the element body such that a portion of the outer electrode protrudes from the one surface of the element body, and the portion of the outer electrode defines a protruding portion. A thickness of an embedded portion of the outer electrode which is embedded in the one surface of the element body is larger than a thickness of the protruding portion of the outer electrode protruding from the one surface of the element body in thickness in a direction perpendicular to the one surface of the element body. Here, the outer electrode is a so-called base electrode, and does not contain plating using such as Ni or Sn.

According to the coil component, since the outer electrode is embedded in the one surface of the element body such that the portion of the outer electrode protrudes from the one surface of the element body, the protruding portion of the outer electrode is fixed to a mounting substrate with solder or the like interposed therebetween when the coil component is mounted on the mounting substrate. Therefore, a contact area between the protruding portion of the outer electrode and the solder is large, and the fixing force between the coil component and the mounting substrate is improved.

Since the thickness of the embedded portion of the outer electrode is larger than the thickness of the protruding portion of the outer electrode, it is possible to secure a contact area between the embedded portion of the outer electrode and the element body. Therefore, it is possible to secure adhesion between the embedded portion of the outer electrode and the element body, and to suppress separation of the outer electrode from the element body.

In an embodiment of the coil component, a ratio of the thickness of the embedded portion of the outer electrode to a sum of the thickness of the embedded portion of the outer electrode and the thickness of the protruding portion of the outer electrode is about 60% or more and about 90% or less (i.e., from about 60% to about 90%).

According to the above-described embodiment, it is possible to effectively achieve both the improvement of the fixing force between the coil component and the mounting substrate, and the suppression of the separation of the outer electrode from the element body. Further, in an embodiment of the coil component, the element body includes a bottom surface, and the outer electrode is provided on the bottom surface.

According to the above-described embodiment, the outer electrode is a so-called bottom surface electrode. Further, in an embodiment of the coil component, the element body includes two end surfaces facing each other and a bottom surface provided between the two end surfaces, and the outer electrode is provided across one of the two end surfaces and the bottom surface, and across the other of the two end surfaces and the bottom surface.

According to the above-described embodiment, the outer electrode is a so-called L-shaped electrode. Further, in an embodiment of the coil component, the outer electrode has a first portion provided on the bottom surface and a second portion provided on each of the end surfaces, a chamfered portion is provided at a corner portion connecting the first portion and the second portion, and a radius of curvature of the chamfered portion of the outer electrode is larger than a radius of curvature of a chamfered portion provided at a corner portion of the element body.

According to the above-described embodiment, by reducing the radius of curvature of the chamfered portion of the element body, it is possible to secure coil characteristics without reducing a volume of the element body. Further, by increasing the radius of curvature of the chamfered portion of the outer electrode, when plating is applied to the outer electrode, it is possible to suppress breakage of the plating at the corner portion of the outer electrode.

Further, in an embodiment of the coil component, the coil is spirally wound along a width direction of the element body, and a height dimension of the element body is larger than a width dimension of the element body.

According to the above-described embodiment, it is possible to increase an inner diameter of the coil, and to improve the coil characteristics.

Further, in an embodiment of a method for manufacturing a coil component, a method for manufacturing any of the above described coil components includes preparing an insulating paste to be an element body and a conductive paste to be an outer electrode having a shrinkage amount smaller than a shrinkage amount of the insulating paste at a time of baking, laminating the insulating paste and the conductive paste to form a multilayer body, and baking the multilayer body. According to the embodiment, it is possible to embed the outer electrode in one surface of the element body such that the insulating paste shrinks more than the conductive paste and a portion of the outer electrode protrudes from the one surface of the element body at the time of baking.

Other features, elements, characteristics and advantages of the present disclosure will become more apparent from the following detailed description of preferred embodiments of the present disclosure with reference to the attached drawings.

DETAILED DESCRIPTION

Hereinafter, the present disclosure will be described in detail with reference to illustrated embodiments.

Embodiments

Figure 1:
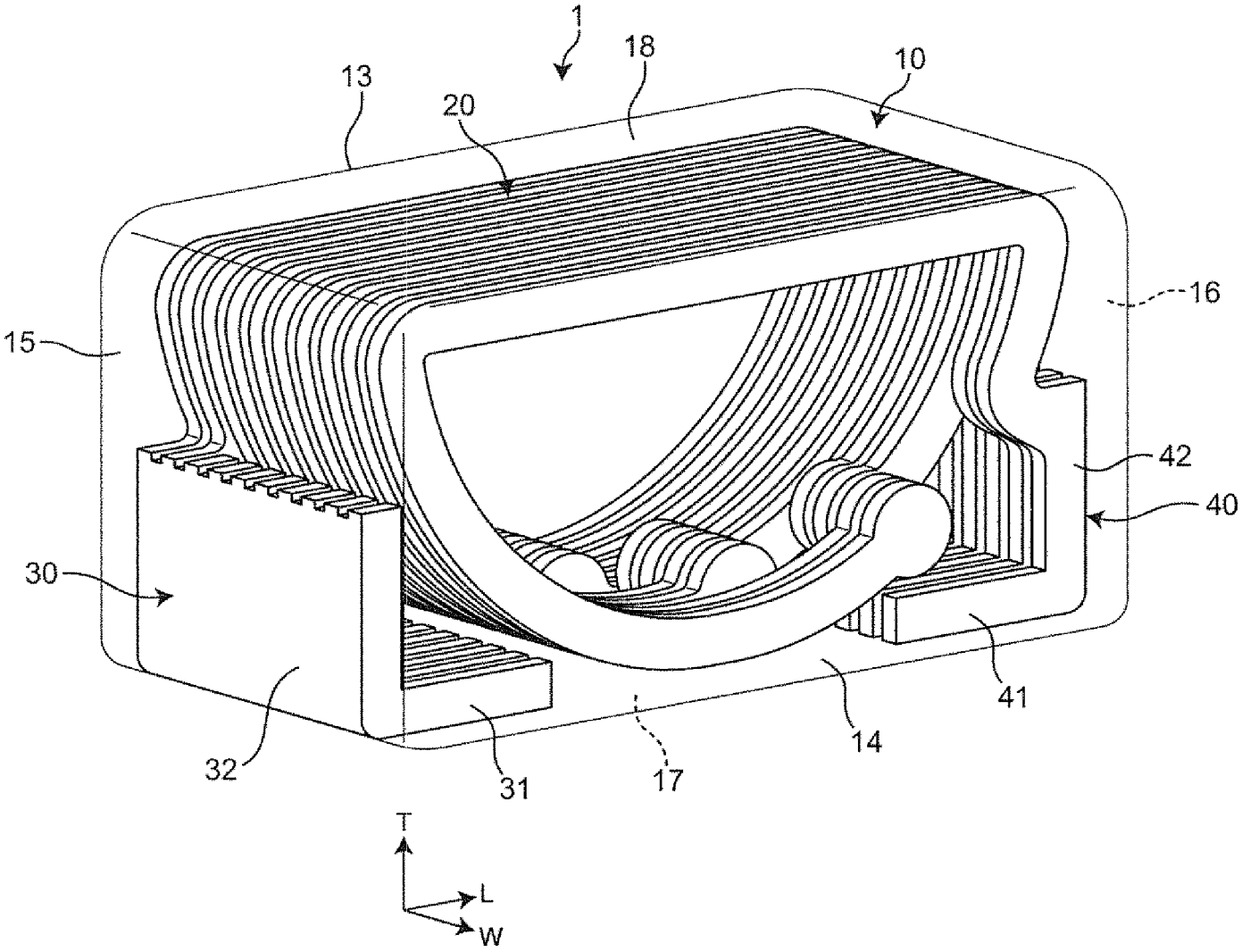
FIG. 1 is a perspective view illustrating an embodiment of a coil component of the present disclosure.

FIG. 1 is a perspective view illustrating an embodiment of a coil component. As illustrated in FIG. 1, a coil component 1 includes an element body 10, a spiral coil 20 provided inside the element body 10, and a first outer electrode 30 and a second outer electrode 40 provided on the element body 10 and electrically connected to the coil 20. In FIG. 1, the element body 10 is depicted as transparent in order to make a structure of the coil component 1 easily comprehensible.

The coil component 1 is electrically connected to wiring of a mounting substrate (not shown) with the first outer electrode 30 and the second outer electrode 40 interposed therebetween. The coil component 1 is used as, for example, an impedance matching coil (matching coil) of a high-frequency circuit, and is used in electronic equipment such as a personal computer, a DVD player, a digital camera, a TV, a cellular phone, a car electronics, a medical machine, an industrial machine, and the like. However, usage of the coil component 1 is not limited thereto, and the coil component 1 may be used for, for example, a tuning circuit, a filter circuit, a rectification smoothing circuit, and the like.

Figure 5:
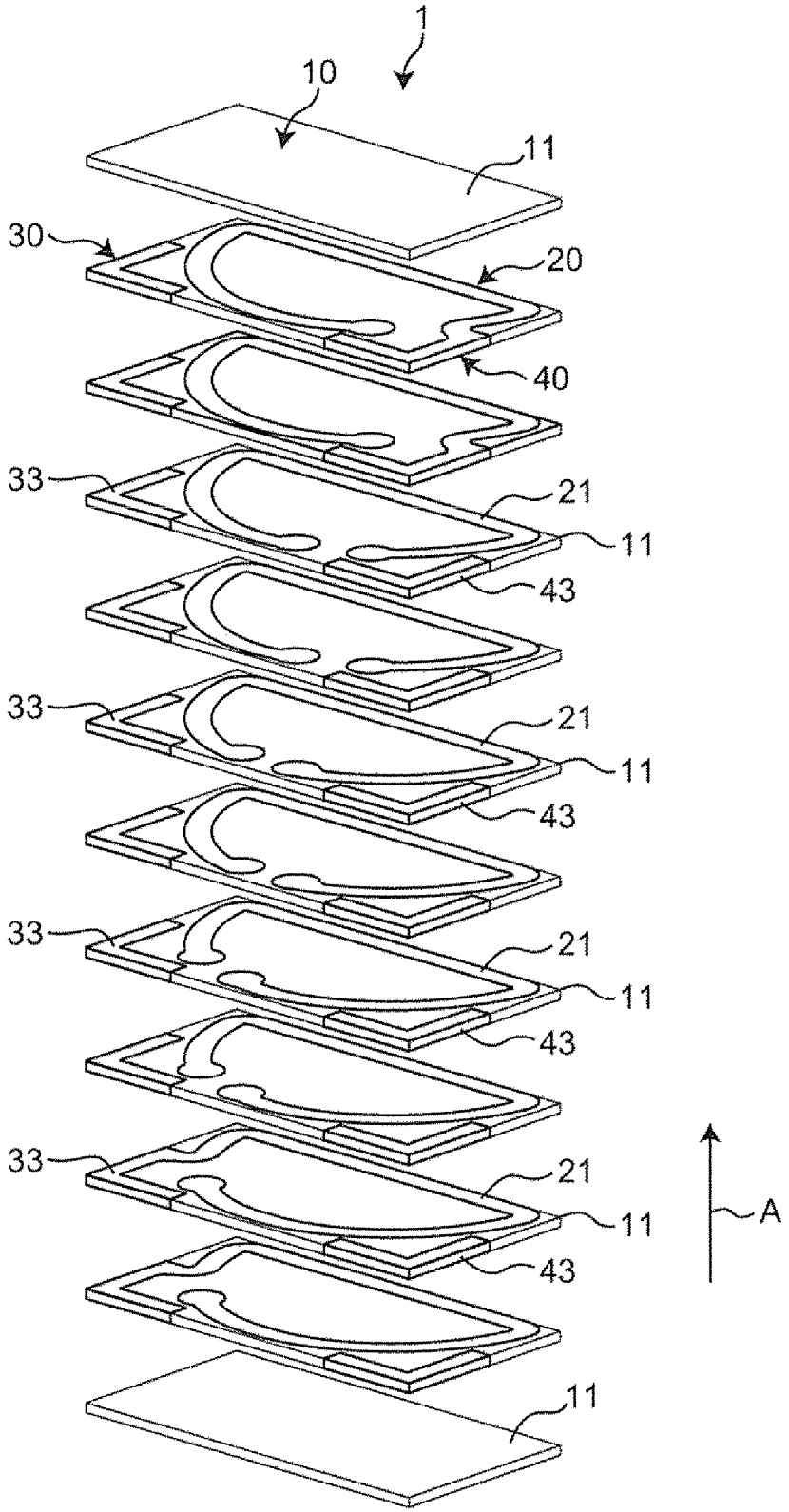
FIG. 5 is an explanatory view illustrating a method for manufacturing the coil component.

The element body 10 is formed by laminating a plurality of insulating layers 11 (see FIG. 5). Each of the insulating layers 11 is made of, for example, a material containing borosilicate glass as a main component or a material such as ferrite or resin. Interfaces between the plurality of insulating layers 11 may be unclear due to baking or the like in the element body 10.

The element body 10 is formed in a substantially rectangular parallelepiped shape. Surfaces of the element body 10 are composed of a first side surface 13, a second side surface 14, a first end surface 15, a second end surface 16, a bottom surface 17, and a top surface 18. The first side surface 13 and the second side surface 14 face each other in a width direction W of the element body 10. The first end surface 15 and the second end surface 16 face each other in a length direction L of the element body 10. The bottom surface 17 and the top surface 18 face each other in a height direction T of the element body 10. The first side surface 13, the second side surface 14, the bottom surface 17 and the top surface 18 are provided between the first end surface 15 and the second end surface 16. The width direction W, the length direction L, and the height direction T are perpendicular to each other.

The first outer electrode 30 and the second outer electrode 40 are made of a conductive material such as Ag, Cu, Au, or alloy containing these as a main component. The first outer electrode 30 and the second outer electrode 40 are referred to as so-called base electrodes, and do not contain plating using such as Ni or Sn. The first outer electrode 30 is substantially L-shaped and provided across the first end surface 15 and the bottom surface 17. The second outer electrode 40 is substantially L-shaped and provided across the second end surface 16 and the bottom surface 17.

The first outer electrode 30 and the second outer electrode 40 have a structure in which a plurality of outer electrode conductor layers 33 and 43 (see FIG. 5) embedded in the element body 10 are laminated. Each of the outer electrode conductor layers 33 of the first outer electrode 30 is substantially L-shaped and has a portion extending along the first end surface 15 and the bottom surface 17, and each of the outer electrode conductor layers 43 of the second outer electrode 40 is substantially L-shaped and has a portion extending along the second end surface 16 and the bottom surface 17. Accordingly, since the outer electrodes 30 and 40 may be embedded in the element body 10, it is possible to reduce a size of the coil component as compared with a configuration in which an outer electrode is externally attached to the element body 10. Further, it is possible to form the coil 20 and the outer electrodes 30 and 40 in the same process, and to reduce variation in positional relationships between the coil 20 and the outer electrodes 30 and 40, thereby reducing variation in electrical characteristics of the coil component 1.

The coil 20 is made of, for example, a conductive material similar to a material of the first outer electrode 30 and the second outer electrode 40. The coil 20 is spirally wound along the width direction W of the element body 10. Here, making a height dimension of the element body 10 larger than a width dimension of the element body 10 makes it possible to increase an inner diameter of the coil 20, thereby improving coil characteristics.

One end of the coil 20 contacts the first outer electrode 30, and the other end of the coil 20 contacts the second outer electrode 40. In the present embodiment, the coil 20, the first outer electrode 30, and the second outer electrode 40 are integrated, and there is no clear boundary therebetween, but the present disclosure is not limited thereto, and a boundary may be present between the coil and the outer electrodes by being formed with different materials or different methods.

The coil 20 includes a plurality of coil conductor layers 21 (see FIG. 5) wound in planar shape on the insulating layers 11. As described above, since the coil 20 is formed of the coil conductor layers 21 capable of being microfabricated, it is possible to reduce a size and a height of the coil component 1. The coil conductor layers 21 adjacent to each other in a lamination direction A of the insulating layers 11 (see FIG. 5) are electrically connected in series using via conductors penetrating the insulating layer 11 in the thickness direction. As described above, the plurality of coil conductor layers 21 are electrically connected in series with each other and constitute a spiral shape. Specifically, the coil 20 has a configuration in which the plurality of coil conductor layers 21 electrically connected in series with each other and each having a number of turns less than one are laminated, and the coil 20 has a substantially helical shape. At this time, it is possible to reduce parasitic capacitance generated in the coil conductor layers 21 and parasitic capacitance generated between the coil conductor layers 21, and to improve a Q value of the coil component 1.

Figure 2:
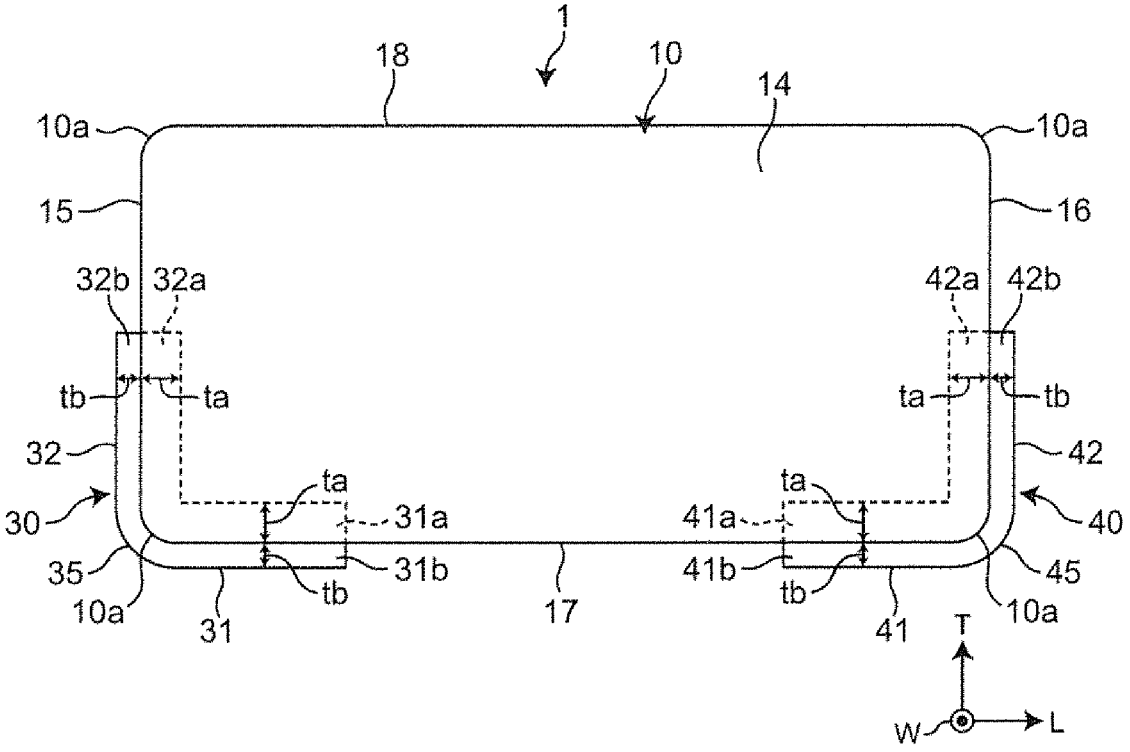
FIG. 2 is a side view of the coil component viewed in a width direction.

FIG. 2 is a side view of the coil component 1 viewed in the width direction W. As illustrated in FIG. 2, the first outer electrode 30 is embedded in the first end surface 15 and the bottom surface 17 of the element body 10 such that a portion of the first outer electrode 30 protrudes from the first end surface 15 and the bottom surface 17 of the element body 10. Each of the first end surface 15 and the bottom surface 17 corresponds to "one surface" according to aspects of the disclosure.

Specifically, the first outer electrode 30 has a first portion 31 provided on the bottom surface 17 and a second portion 32 provided on the first end surface 15. The first portion 31 has an embedded portion 31*a* embedded in the bottom surface 17 of the element body 10 and a protruding portion 31*b* protruding from the bottom surface 17 of the element body 10. The second portion 32 has an embedded portion 32*a* embedded in the first end surface 15 of the element body 10 and a protruding portion 32*b* protruding from the first end surface 15 of the element body 10.

In thickness in a direction perpendicular to the bottom surface 17 of the element body 10, a thickness ta of the embedded portion 31*a* of the first portion 31 is larger than a thickness tb of the protruding portion 31*b* of the first portion 31. In thickness in a direction perpendicular to the first end surface 15 of the element body 10, the thickness ta of the embedded portion 32*a* of the second portion 32 is larger than the thickness tb of the protruding portion 32*b* of the second portion 32.

Accordingly, since the first outer electrode 30 is embedded in the first end surface 15 and the bottom surface 17 of the element body 10 such that a portion of the first outer electrode 30 protrudes from the first end surface 15 and the bottom surface 17 of the element body 10, the protruding portions 31*b* and 32*b* of the first outer electrode 30 are fixed to the mounting substrate with solder or the like interposed therebetween when the coil component 1 is mounted on the mounting substrate. Therefore, a contact area between the protruding portions 31*b* and 32*b* of the first outer electrode 30 and the solder is large, and fixing force between the coil component 1 and the mounting substrate is improved.

Since the thickness ta of the embedded portions 31*a* and 32*a* of the first outer electrode 30 is larger than the thickness tb of the protruding portions 31*b* and 32*b* of the first outer electrode 30, it is possible to secure a contact area between the embedded portions 31*a* and 32*a* of the first outer electrode 30 and the element body 10. Therefore, it is possible to secure adhesion between the embedded portions 31*a* and 32*a* of the first outer electrode 30 and the element body 10, and to suppress separation of the first outer electrode 30 from the element body 10.

Preferably, a ratio of the thickness ta of the embedded portion 31*a* of the first portion 31 to a sum of the thickness ta of the embedded portion 31*a* of the first portion 31 and the thickness tb of the protruding portion 31*b* of the first portion 31 is about 60% or more and about 90% or less (i.e., from about 60% to about 90%). Preferably, a ratio of the thickness ta of the embedded portion 32*a* of the second portion 32 to a sum of the thickness ta of the embedded portion 32*a* of the second portion 32 and the thickness tb of the protruding portion 32*b* of the second portion 32 is about 60% or more and about 90% or less (i.e., from about 60% to about 90%). Accordingly, it is possible to effectively achieve both the improvement of the fixing force between the coil component 1 and the mounting substrate and the suppression of the separation of the first outer electrode 30 from the element body 10.

As illustrated in FIG. 2, the second outer electrode 40 is embedded in the second end surface 16 and the bottom surface 17 of the element body 10 such that a portion of the second outer electrode 40 protrudes from the second end surface 16 and the bottom surface 17 of the element body 10. Each of the second end surface 16 and the bottom surface 17 corresponds to "one surface" according to aspects of the disclosure. A configuration of the second outer electrode 40 is similar to the configuration of the first outer electrode 30.

Specifically, the second outer electrode 40 has a first portion 41 provided on the bottom surface 17 and a second portion 42 provided on the second end surface 16. The thickness ta of the embedded portion 41*a* of the first portion 41 is larger than the thickness tb of the protruding portion 41*b* of the first portion 41. The thickness ta of the embedded portion 42*a* of the second portion 42 is larger than the thickness tb of the protruding portion 42*b* of the second portion 42.

Accordingly, since the second outer electrode 40 is embedded in the element body 10 such that a portion of the second outer electrode 40 protrudes from the element body 10, the protruding portions 41*b* and 42*b* of the second outer electrode 40 are fixed to the mounting substrate with solder or the like interposed therebetween when the coil component 1 is mounted on the mounting substrate. Therefore, a contact area between the protruding portions 41*b* and 42*b* of the second outer electrode 40 and the solder is large, and the fixing force between the coil component 1 and the mounting substrate is improved.

Since the thickness ta of the embedded portions 41*a* and 42*a* of the second outer electrode 40 is larger than the thickness tb of the protruding portions 41*b* and 42*b* of the second outer electrode 40, it is possible to secure a contact area between the embedded portions 41*a* and 42*a* of the second outer electrode 40 and the element body 10. Therefore, it is possible to secure adhesion between the embedded portions 41*a* and 42*a* of the second outer electrode 40 and the element body 10, and to suppress separation of the second outer electrode 40 from the element body 10.

Preferably, a ratio of the thickness ta of the embedded portion 41*a* of the first portion 41 to a sum of the thickness ta of the embedded portion 41*a* of the first portion 41 and the thickness tb of the protruding portion 41*b* of the first portion 41 is about 60% or more and about 90% or less (i.e., from about 60% to about 90%). Preferably, a ratio of the thickness ta of the embedded portion 42*a* of the second portion 42 to a sum of the thickness ta of the embedded portion 42*a* of the second portion 42 and the thickness tb of the protruding portion 42*b* of the second portion 42 is about 60% or more and about 90% or less (i.e., from about 60% to about 90%). Accordingly, it is possible to effectively achieve both the improvement of the fixing force between the coil component 1 and the mounting substrate and the suppression of the separation of the second outer electrode 40 from the element body 10.

Figure 3:
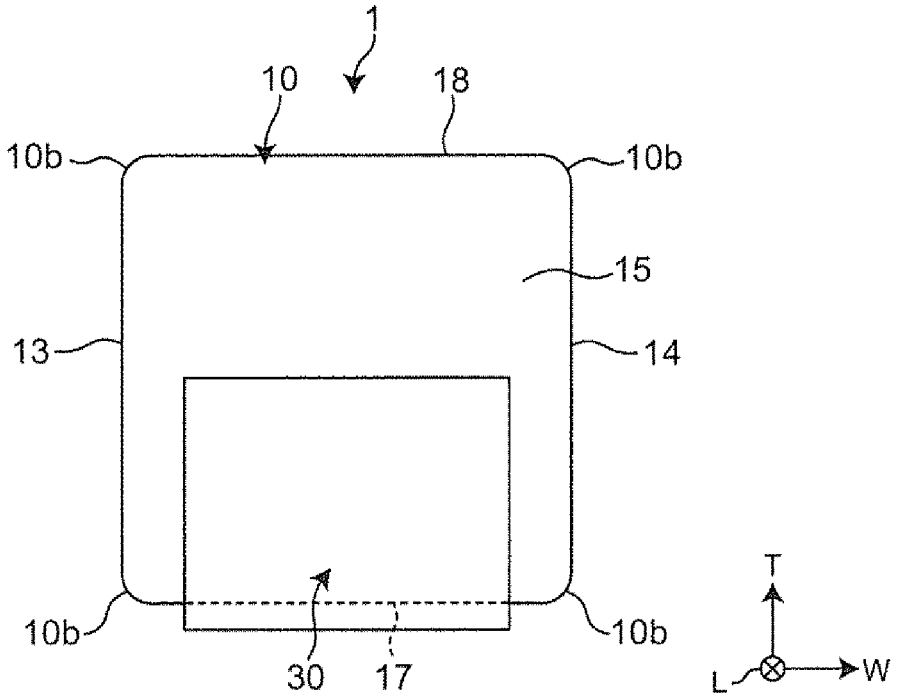
FIG. 3 is an end view of the coil component viewed in a length direction.
Figure 4:
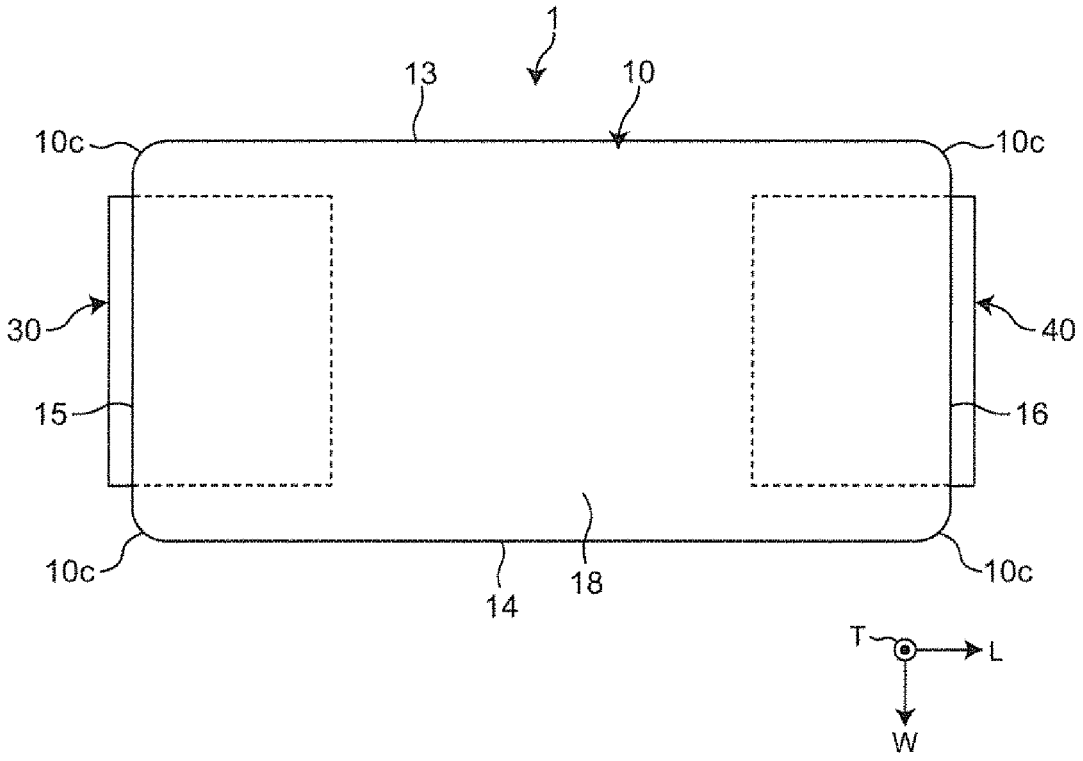
FIG. 4 is a top view of the coil component viewed in a height direction.

FIG. 3 is an end view of the coil component 1 viewed in the length direction L. FIG. 4 is a top view of the coil component 1 viewed in the height direction T. As illustrated in FIGS. 2, 3, and 4, a chamfered portion 35 is provided at a corner portion of the first outer electrode 30 which connects the first portion 31 and the second portion 32. A radius of curvature of the chamfered portion 35 of the first outer electrode 30 is larger than respective radiuses of curvature of the chamfered portions 10*a*, 10*b*, and 10*c* provided at respective corner portions of the element body 10.

Specifically, the first outer electrode 30 has the chamfered portion 35 at a corner portion on a plane (LT plane) perpendicular to the width direction W when viewed in the width direction W. The element body 10 has first chamfered portions 10*a*, second chamfered portions 10*b*, and third chamfered portions 10*c*. The first chamfered portions 10*a* are provided at respective corner portions on the plane (LT plane) perpendicular to the width direction W when viewed in the width direction W. The second chamfered portions 10*b* are provided at respective corner portions on a plane (WT plane) perpendicular to the length direction L when viewed in the length direction L. The third chamfered portions 10*c* are provided at respective corner portions on a plane (LW plane) perpendicular to the height direction T when viewed in the height direction T. The radius of curvature of the chamfered portion 35 of the first outer electrode 30 is larger than a radius of curvature of the first chamfered portions 10*a*, a radius of curvature of the second chamfered portions 10*b*, and a radius of curvature of the third chamfered portions 10*c*.

Accordingly, by reducing the respective radiuses of curvature of the chamfered portions 10*a*, 10*b*, and 10*c* of the element body 10, it is possible to secure the coil characteristics without reducing a volume of the element body 10. Further, by increasing the radius of curvature of the chamfered portion 35 of the first outer electrode 30, when plating is applied to the first outer electrode 30, it is possible to suppress breakage of the plating at a corner portion of the first outer electrode 30.

As illustrated in FIGS. 2, 3 and 4, similarly to the first outer electrode 30, a chamfered portion 45 is provided at a corner portion of the second outer electrode 40 which connects the first portion 41 and the second portion 42. A radius of curvature of the chamfered portion 45 of the second outer electrode 40 is larger than the respective radiuses of curvature of the chamfered portions 10*a*, 10*b*, and 10*c* provided at respective corner portions of the element body 10.

Accordingly, by reducing the respective radiuses of curvature of the chamfered portions 10*a*, 10*b*, and 10*c* of the element body 10, it is possible to secure the coil characteristics without reducing the volume of the element body 10. Further, by increasing the radius of curvature of the chamfered portion 45 of the second outer electrode 40, when plating is applied to the second outer electrode 40, it is possible to suppress breakage of the plating at a corner portion of the second outer electrode 40.

Next, a method for manufacturing the coil component 1 will be described.

An insulating paste to be the element body 10 and a conductive paste to be the first outer electrode 30 and the second outer electrode 40 and the coil 20 are prepared. A shrinkage amount of the insulating paste at a time of baking is larger than a shrinkage amount of the conductive paste at a time of baking.

As illustrated in FIG. 5, the insulating paste and the conductive paste are laminated to form a multilayer body. In other words, a plurality of insulating layers 11 are formed using the insulating paste, the coil conductor layer 21 and the outer electrode conductor layers 33 and 43 are formed using the conductive paste on each of the insulating layers 11, and the plurality of insulating layers 11 are laminated in the lamination direction A. Note that the lamination direction A of the insulating layers 11 coincides with the width direction W of the element body 10.

Thereafter, the multilayer body is baked. At this time, since the shrinkage amount of the insulating paste at the time of baking is larger than the shrinkage amount of the conductive paste at the time of baking, the insulating paste shrinks more than the conductive paste at the time of baking, and the first outer electrode 30 and the second outer electrode 40 can be embedded in one surface of the element body 10 such that portions of the first outer electrode 30 and the second outer electrode 40 protrude from the one surface of the element body 10. Thus, it is possible to manufacture the coil component 1.

Note that the present disclosure is not limited to the above-described embodiments, and design may be changed without departing from the gist of the present disclosure.

In the above-described embodiment, the outer electrode may be a so-called bottom surface electrode provided only on the bottom surface. The outer electrode may be a so-called five-surface electrode provided across the top surface, the bottom surface, and the side surfaces from the end surface.

In the above-described embodiment, the coil may be constituted by a wire such as an insulated and coated copper wire. In the above-described embodiment, the number of turns of the coil conductor layer may be one or more, that is, the coil conductor layer may have a substantially spiral shape wound on a plane.

EXAMPLES

Next, an example of a method for manufacturing a coil component will be described.

a) Preparation of Insulating Paste

Oxide powders of $Fe_2O_3$, ZnO, NiO and CuO are each prepared, weighed so as to have predetermined composition, thoroughly mixed by a wet method, dried, calcined at a temperature of about 700° C. to about 800° C. for about 2 hours, and pulverized to obtain a ferrite powder. Respective predetermined amounts of a solvent (e.g., a ketone-based solvent), a plasticizer (e.g., an alkyd-based plasticizer), and resin (e.g., a polyvinyl acetal, or the like) are added to the powder, kneaded by a planetary mixer, and subsequently dispersed by a triple roll mill to prepare an insulating paste.

b) Preparation of Conductive Paste

Respective predetermined amounts of a solvent (such as eugenol), resin (such as ethyl cellulose), and a dispersant are added to a Ag powder, and the powder is kneaded and dispersed by the planetary mixer and the triple roll mill to prepare a conductive paste in the same manner.

Here, by increasing a PVC (pigment volume concentration) which is concentration of a volume of the Ag powder relative to a volume of a total of the Ag powder and resin component, it is possible to make a shrinkage ratio at a time of baking smaller than that of an insulating layer formed of the insulating paste. As a result, it is possible to adjust an amount of protrusion of an outer electrode from a surface of an element body.

c) Preparation of Coil Component

The prepared insulating paste is screen-printed on a substrate sheet (e.g., a thermosensitive adhesive sheet such as an Intelimer (registered trademark) tape) and dried multiple times, and an insulating layer having a predetermined thickness is formed.

Patterns to be a coil and an outer electrode each having a predetermined shape are screen-printed on the insulating layer using the conductive paste. The insulating paste is printed on a portion where the conductive paste is not printed.

Then, the conductive paste is printed on a portion corresponding to the outer electrode and a portion corresponding to a via such that an upper coil pattern and a lower coil pattern are electrically conductive. The insulating paste is printed on other portions.

The above steps are repeated, and finally, the insulating paste is printed on the entire surface to form a layer to be an exterior.

A block of the multilayer body prepared as described above is cut by a dicer into individual pieces. After the multilayer body is made into individual pieces, heat is applied to separate an element from the substrate sheet. The separated element is subjected to barrel-polishing by a wet method or a dry method. Thereafter, the element is placed in a baking furnace and baked in the atmosphere at a temperature of about 800° C. to about 900° C. for about 2 hours.

Figure 8:
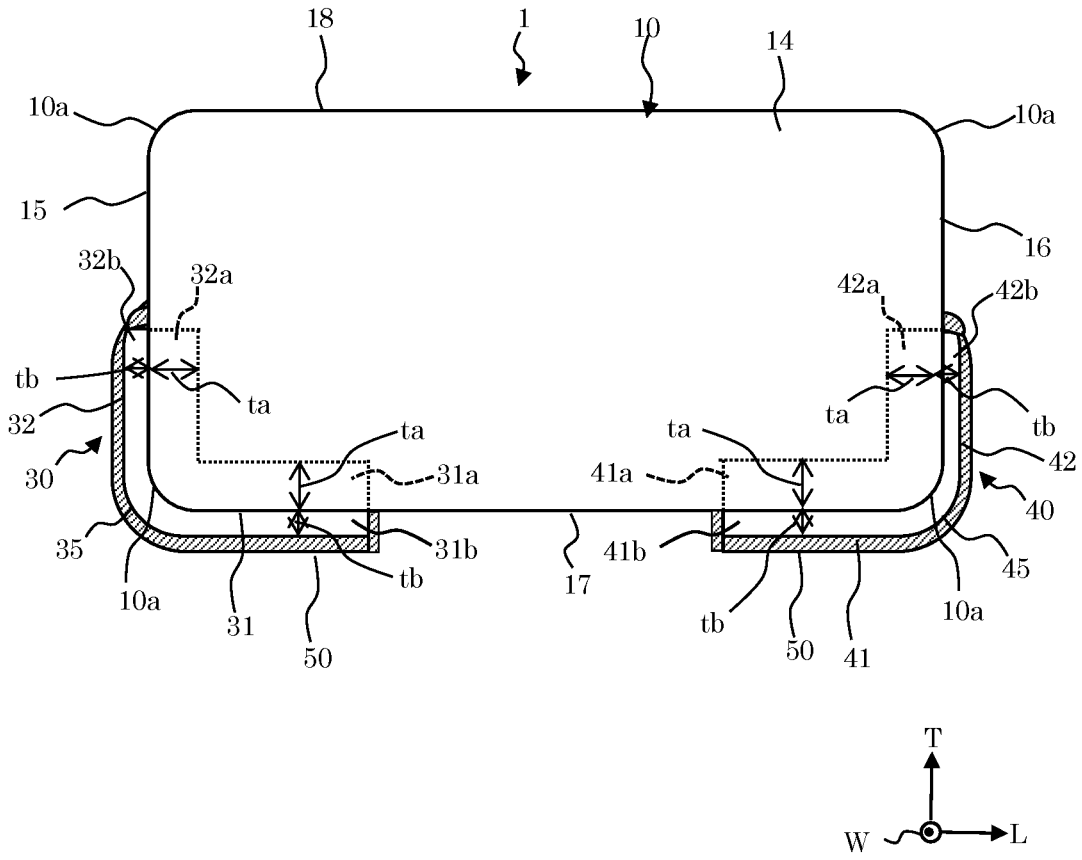
FIG. 8 is a side view of the coil component viewed in a width direction side view of the coil component.

As shown in FIG. 8, a plated layer 50 of Ni and Sn is sequentially formed on an outer electrode (base electrode) made of Ag by electroless plating to manufacture a coil component. Dimensions of the completed coil component are L=about 1.0 mm, W=about 0.5 mm, and T=about 0.7 mm.

A material constituting the insulating paste is not limited to a ferrite material, and may be an insulating material such as glass ceramic or alumina. When a ferrite material is used, it is preferable to use a ferrite material composed of about 40 to about 49.5 mol % of $Fe_2O_3$, about 5 to about 35 mol % of ZnO, about 6 to about 12 mol % of CuO, and the remainder of NiO, and the ferrite material may contain, as an additive, $Mn_3O_4$, $Co_3O_4$, $SnO_2$, $Bi_2O_3$, $SiO_2$, and a micro amount of unavoidable impurities as necessary. Although Ag, Cu, Pd, Pt, or the like is used for the conductive paste constituting the coil, Ag is most preferable.

Method for Measuring Thicknesses of Embedded Portion and Protruding Portion of Outer Electrode Next, a method for measuring respective thicknesses of an embedded portion and a protruding portion of the outer electrode will be described.

A periphery of the coil component is reinforced by resin in order to expose a side surface of the coil component in the LT plane. Polishing is performed to about half the coil component (substantially middle) in the W direction by a polishing machine. Ion milling is performed (using an ion milling apparatus IM4000 manufactured by Hitachi High-Technologies Co., Ltd.) for an obtained cross section to remove sagging caused by the polishing, thereby obtaining a cross section for observation.

Figure 6:
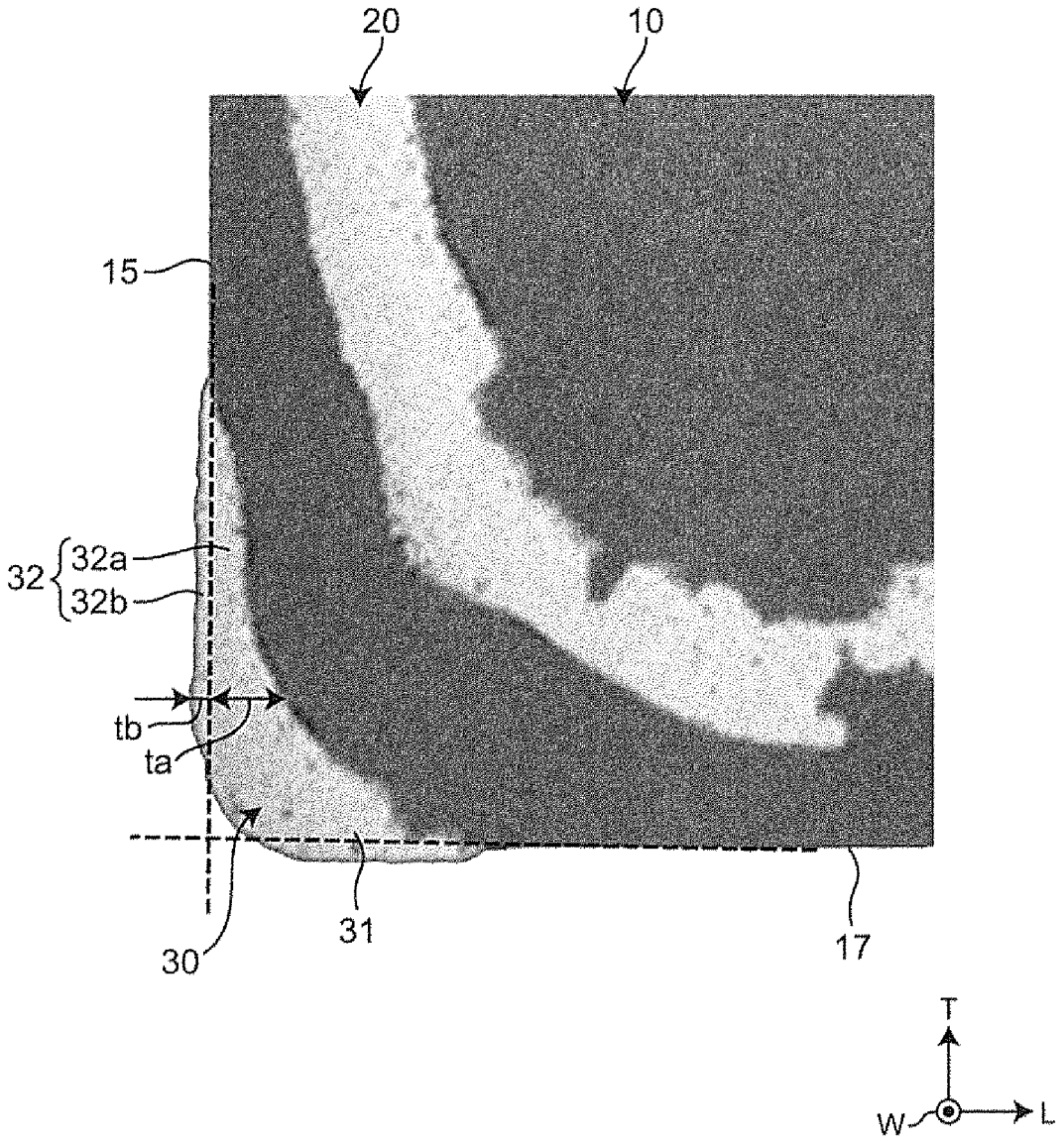
FIG. 6 is an image diagram illustrating a method for measuring a thickness of an outer electrode.

As illustrated in FIG. 6, a portion of the first outer electrode 30 is photographed by an SEM. Using an obtained photograph, respective extension lines of the first end surface 15 (WT plane) and the bottom surface 17 (LW plane) of the element body 10 are drawn. Hereinafter, the second portion 32 of the first outer electrode 30 will be described, but the same applies to the first portion 31.

At a point where the first outer electrode 30 is most protruded from the extension line of the end surface 15, an amount of protrusion of the first outer electrode 30, in a direction opposite to the element body 10, that is most protruded from the extension line is defined as the thickness tb of the protruding portion 32*b*, an amount embedded in the element body 10 side from the extension line is defined as the thickness ta of the embedded portion 32*a*, and the respective thicknesses are measured. Similar measurement is performed for three coil components, and each of the average values of the thicknesses tb of the protruding portions 32*b* and the thicknesses ta of the embedded portions 32*a* is obtained respectively.

From the respective average values, ta/(ta+tb)×100(%) is calculated, and this is defined as a ratio of the thickness ta of the embedded portion 32*a* to a sum of the thickness ta of the embedded portion 32*a* and the thickness tb of the protruding portion 32*b*. The ratio of the thickness ta of the embedded portion 32*a* is preferably about 60% to about 90%. The same applies to a ratio of a thickness of an embedded portion of the first portion 31, and the same applies to a first portion and a second portion of a second outer electrode.

Further, the thickness tb of the protruding portion 32*b* is preferably about 5 to about 100 μm, more preferably about 5 to about 50 μm, and even more preferably about 5 to about 30 μm. The same applies to a thickness of a protruding portion of the first portion 31, and the same applies to the first portion and the second portion of the second outer electrode.

Method for Measuring Radius of Curvature of Chamfered Portion

Next, a method for measuring respective radiuses of curvature of chamfered portions of the element body and the outer electrode will be described.

An SEM photograph of the chamfered portion of the outer electrode and the element body is taken in the coil component polished for measuring the thickness of the outer electrode.

Figure 7:
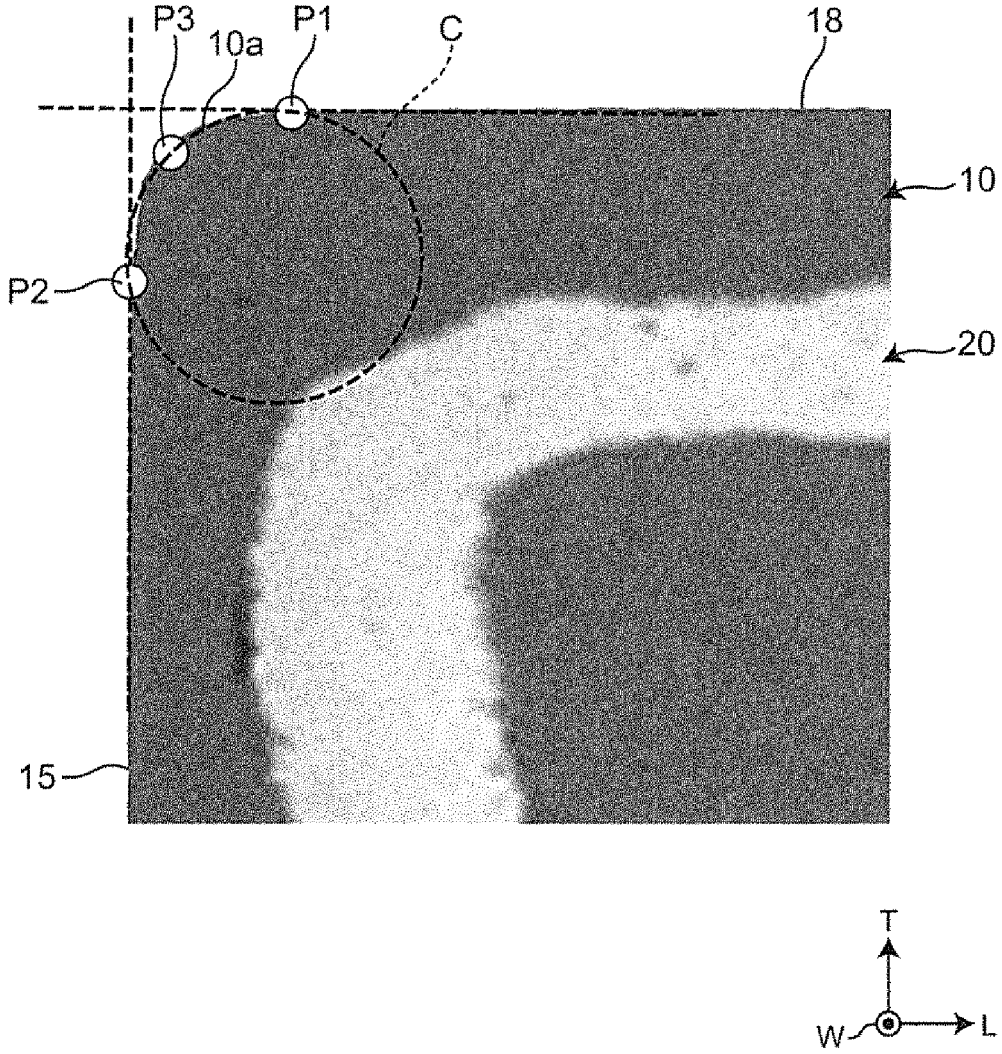
FIG. 7 is an image diagram illustrating a method for measuring a radius of curvature of a chamfered portion.

As illustrated in FIG. 7, extension lines of the first end surface 15 (WT plane) and the top surface 18 (LW plane) of the element body 10 are drawn. A radius of a circle C connecting a first point P1 at which the extension line of the top surface 18 is separated from the element body 10, a second point P2 at which the extension line of the first end surface 15 is separated from the element body 10, and a third point P3 at a center of the chamfered portion 10*a* of the element body 10 is defined as a radius of curvature of the chamfered portion 10*a* of the element body 10. Similar measurement is performed for three coil components, and an average value of the radiuses of curvature of the chamfered portions 10*a* of the element bodies 10 is obtained.

Similarly, a radius of curvature of the chamfered portion of the outer electrode is measured. Similar measurement is performed for three coil components, and an average value of the radiuses of curvature of the chamfered portions of the outer electrodes is obtained. The radius of curvature of the chamfered portion of the outer electrode is preferably larger than the radius of curvature of the chamfered portion 10*a* of the element body 10, the radius of curvature of the chamfered portion 10*a* of the element body 10 is preferably in a range of about 20 μm to about 50 μm, and the radius of curvature of the chamfered portion of the outer electrode is preferably in a range of about 50 μm to about 100 μm.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

an element body, the element body includes a bottom surface and two end surfaces;

a coil provided in the element body;

an outer electrode provided on the element body and electrically connected to the coil, the outer electrode is provided at least on the bottom surface of the element body, the outer electrode being formed as a single piece and partially embedded in the element body to form a protruding portion and an embedded portion, and a plated layer formed on the outer electrode, wherein the embedded portion of the outer electrode is embedded in one surface of the element body such that the protruding portion of the outer electrode protrudes from the one surface of the element body, and the protruding portion is in a single piece with the embedded portion, and a thickness of the embedded portion of the outer electrode is larger than a thickness of the protruding portion of the outer electrode protruding from the one surface of the element body in thickness in a direction perpendicular to the bottom surface of the element body.

2. The coil component according claim 1, wherein a ratio of the thickness of the embedded portion of the outer electrode to a sum of the thickness of the embedded portion of the outer electrode and the thickness of the protruding portion of the outer electrode is from about 60% to about 90%.

3. The coil component according to claim 1, wherein the two end surfaces face each other, and the bottom surface is provided between the two end surfaces, and the outer electrode is provided across one of the two end surfaces and the bottom surface, and across an other of the two end surfaces and the bottom surface.

4. The coil component according to claim 3, wherein the outer electrode has a first portion provided on the bottom surface and a second portion provided on each of the end surfaces, a chamfered portion is provided at a corner portion connecting the first portion and the second portion, and a radius of curvature of the chamfered portion of the outer electrode is larger than a radius of curvature of a chamfered portion provided at a corner portion of the element body.

5. The coil component according to claim 1, wherein the coil is spirally wound along a width direction of the element body, and a height dimension of the element body is larger than a width dimension of the element body.

6. The coil component according to claim 2, wherein the element body includes a bottom surface, and the outer electrode is provided on the bottom surface.

7. The coil component according to claim 2, wherein the two end surfaces face each other, and the bottom surface is provided between the two end surfaces, and the outer electrode is provided across one of the two end surfaces and the bottom surface, and across an other of the two end surfaces and the bottom surface.

8. The coil component according to claim 7, wherein the outer electrode has a first portion provided on the bottom surface and a second portion provided on each of the end surfaces, a chamfered portion is provided at a corner portion connecting the first portion and the second portion, and a radius of curvature of the chamfered portion of the outer electrode is larger than a radius of curvature of a chamfered portion provided at a corner portion of the element body.

9. The coil component according to claim 2, wherein the coil is spirally wound along a width direction of the element body, and a height dimension of the element body is larger than a width dimension of the element body.

10. The coil component according to claim 3, wherein the coil is spirally wound along a width direction of the element body, and a height dimension of the element body is larger than a width dimension of the element body.

11. The coil component according to claim 4, wherein the coil is spirally wound along a width direction of the element body, and a height dimension of the element body is larger than a width dimension of the element body.

12. The coil component according to claim 6, wherein the coil is spirally wound along a width direction of the element body, and a height dimension of the element body is larger than a width dimension of the element body.

13. The coil component according to claim 7, wherein the coil is spirally wound along a width direction of the element body, and a height dimension of the element body is larger than a width dimension of the element body.

14. The coil component according to claim 8, wherein the coil is spirally wound along a width direction of the element body, and a height dimension of the element body is larger than a width dimension of the element body.

15. A method for manufacturing the coil component according to claim 1, the method comprising:

preparing an insulating paste to be the element body and a conductive paste to be the outer electrode having a shrinkage amount smaller than a shrinkage amount of the insulating paste at a time of baking, laminating the insulating paste and the conductive paste to form a multilayer body, and baking the multilayer body.

16. A method for manufacturing the coil component according to claim 2, the method comprising:

preparing an insulating paste to be the element body and a conductive paste to be the outer electrode having a shrinkage amount smaller than a shrinkage amount of the insulating paste at a time of baking, laminating the insulating paste and the conductive paste to form a multilayer body, and baking the multilayer body.

17. A method for manufacturing the coil component according to claim 4, the method comprising:

preparing an insulating paste to be the element body and a conductive paste to be the outer electrode having a shrinkage amount smaller than a shrinkage amount of the insulating paste at a time of baking, laminating the insulating paste and the conductive paste to form a multilayer body, and baking the multilayer body.

18. A method for manufacturing the coil component according to claim 3, the method comprising:

preparing an insulating paste to be the element body and a conductive paste to be the outer electrode having a shrinkage amount smaller than a shrinkage amount of the insulating paste at a time of baking, laminating the insulating paste and the conductive paste to form a multilayer body, and baking the multilayer body.

* * * * *